US007380595B2

(12) United States Patent
Wetzel et al.

(10) Patent No.: US 7,380,595 B2
(45) Date of Patent: Jun. 3, 2008

(54) SYSTEM AND METHOD TO DEPLOY AND EXPAND TUBULAR COMPONENTS DEPLOYED THROUGH TUBING

(75) Inventors: Rodney J. Wetzel, Katy, TX (US); Don Eubank, Tulsa, OK (US); Matthew R. Hackworth, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 309 days.

(21) Appl. No.: 10/905,721

(22) Filed: Jan. 18, 2005

(65) Prior Publication Data

US 2005/0155773 A1 Jul. 21, 2005

Related U.S. Application Data

(60) Provisional application No. 60/537,853, filed on Jan. 21, 2004.

(51) Int. Cl.
*E21B 43/10* (2006.01)

(52) U.S. Cl. ..... 166/227; 166/207; 166/277

(58) Field of Classification Search ..... 166/277, 166/207, 227

See application file for complete search history.

(56) References Cited

U.S. PATENT DOCUMENTS 2,812,025 A * 11/1957 Teague et al. ..... 166/207
4,501,327 A 2/1985 Retz
4,865,127 A 9/1989 Koster
5,456,319 A 10/1995 Schmidt et al.
5,613,557 A * 3/1997 Blount et al. ..... 166/277
5,702,109 A 12/1997 Mahin et al.
6,012,522 A 1/2000 Donnelly et al.
6,019,136 A * 2/2000 Walsh et al. ..... 138/98
6,044,906 A 4/2000 Saltel
6,250,385 B1 6/2001 Montaron
6,478,091 B1 11/2002 Gano
6,516,506 B2 2/2003 Donnelly et al.
6,607,032 B2 8/2003 Voll et al.
2001/0039711 A1* 11/2001 Donnelly et al. ..... 29/450
2002/0084070 A1 7/2002 Voll et al.
2002/0162664 A1* 11/2002 Bode et al. ..... 166/380
2002/0179306 A1* 12/2002 Johnson et al. ..... 166/380
2003/0106688 A1 6/2003 Saugier
2003/0145992 A1 8/2003 Corre et al.
2003/0221840 A1 12/2003 Whitelaw et al.

FOREIGN PATENT DOCUMENTS

WO WO 97/17524 A2 5/1997
WO WO 02/23009 A2 3/2002

* cited by examiner

*Primary Examiner*—Giovanna C Wright
(74) *Attorney, Agent, or Firm*—Fred G. Pruner; Daryl R. Wright; Bryan P. Galloway

(57) ABSTRACT

A system that is usable with a wellbore includes a deployment tool that is attached to a conveyance device and has an unexpanded state and an expanded state. The system also includes a scrolled tubular, such as a sand screen, which is attached to the deployment tool. The tubular is scrolled around the deployment tool in the unexpanded state with the scrolled tubular having an outer diameter that is less than an inner diameter of a tubing that is located in the wellbore. The tubular is then unscrolled to expand against a surface in an expanded state of the tubular.

15 Claims, 9 Drawing Sheets

SYSTEM AND METHOD TO DEPLOY AND EXPAND TUBULAR COMPONENTS DEPLOYED THROUGH TUBING

CROSS-REFERENCE TO RELATED APPLICATIONS

The following is based on and claims priority to Provisional Application Ser. No. 60/537,853, filed Jan. 21, 2004.

BACKGROUND OF THE INVENTION

1. Field of Invention

The present invention relates to the field of downhole tools used in a subterranean wellbore. More specifically, the invention relates to a tubular downhole component (such as a sand screen, tubing, or casing) that is run in an unexpanded state through a tubing and is then expanded downhole from the tubing.

Wells that are already in existence and that are cased may intersect hydrocarbon formations that were not initially targeted and have therefore not been tapped. Many of these wells have already been completed and include a production tubing and packer as known in the field. Currently, in order to recover the hydrocarbons from the untapped formations, operators perforate the previously untapped formations and then deploy a screen, having an OD less than the existing tubing ID, and blank assembly adjacent to and extending above the untapped interval. However, this approach requires that some amount of blank pipe extends above the top perforation. In certain cases the blank pipe will then be positioned adjacent to another untapped formation and hinder future access to that formation.

More generally, operators are often faced with the need to deploy downhole tubular components through tubing and then expand such components downhole of the tubing to an expanded diameter equal to or greater than that of the tubing.

Thus, there is a continuing need to address one or more of the problems stated above.

SUMMARY

The present invention is a method and system for deploying an expandable tubular, such as a sand screen, through a tubing in a subterranean wellbore. The system comprises a deployment tool attached to a conveyance device and having an unexpanded state and an expanded state and a scrolled tubular attached to the deployment tool. The tubular is scrolled around the deployment tool in the unexpanded state with the scrolled sand screen having an outer diameter that is less than an inner diameter of the tubing. The tubular is then unscrolled to expand against a surface in the expanded position.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In general the invention comprises deploying a downhole tubular component through a tubing and expanding the component downhole of the tubing. The tubular can comprise any component that is tubular in shape, including a sand screen, a tubing, a liner, or a casing. In one embodiment, the component is expanded to an expanded diameter equal to or greater than that of the tubing. When expanded, the component has its usual function (i.e. the sand screen filters sand, the casing cases the wellbore). More detail of the system and method of the present invention will be disclosed below in relation to a sand screen, although it is understood that the component can comprise components other than a screen.

FIGS. 1-4 illustrate a process for running one embodiment of the present invention. In general, the process encompasses running an unexpanded sand screen 20 on a deployment tool 22 through tubing 24 and expanding the sand screen 20 by use of the deployment tool 22. In one embodiment, the sand screen 20 is expanded against a casing 26 once the deployment tool 22 positions the sand screen 20 past or downhole from the tubing 24. In another embodiment (not shown), the sand screen 20 is expanded against a wellbore wall (in open holes).

Figure 1:
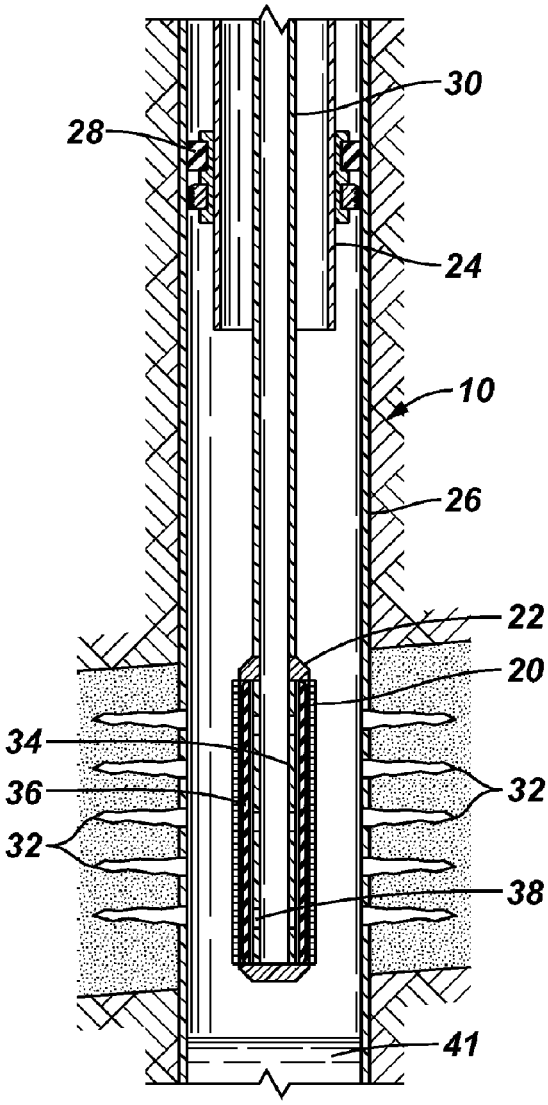
FIGS. 1-4 illustrate one embodiment of the present invention.
Figure 16:
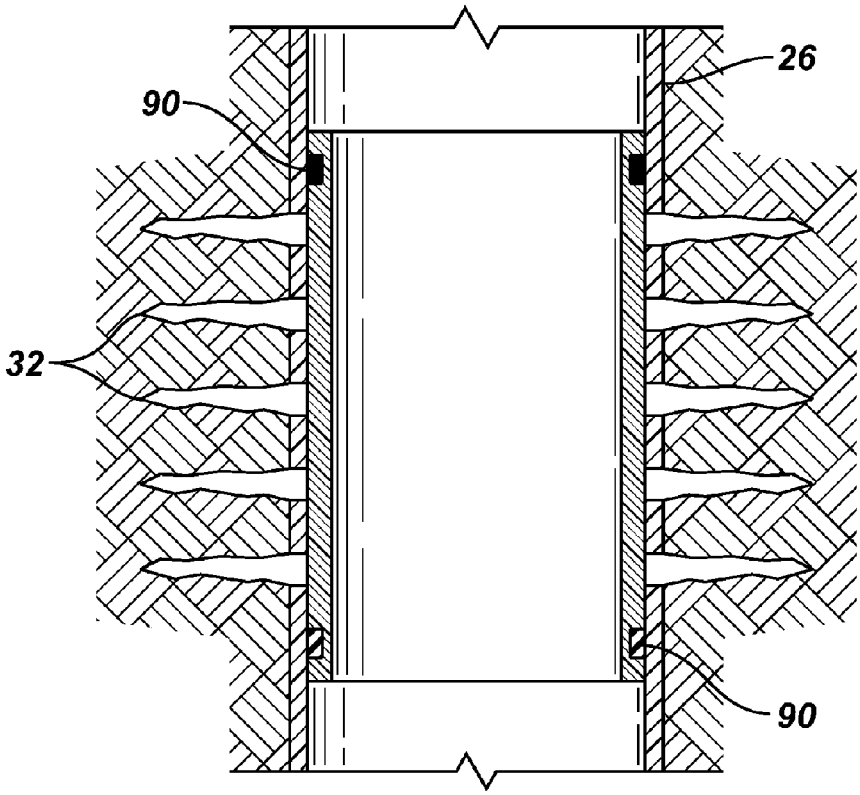
FIG. 16 illustrates one embodiment of the present invention with the screen in an expanded state.

FIG. 1 shows the sand screen 20 being deployed on a deployment tool 22 through a tubing 24 within a wellbore 10 that is cased with casing 26. Tubing 24 can comprise production tubing commonly utilized in the industry. A packer 28 is typically connected to tubing 24. As known in the art, packer 28 seals against casing 26 and secures tubing 24 to casing 26. Deployment tool 22 is conveyed through the tubing 24 on a conveyance device 30 that can comprise a metal tubing, a coiled tubing, a wireline, or a slickline. The outer circumference of the conveyance device 30 and the unexpanded sand screen 20 disposed on the deployment tool 22 is of a size that allows its deployment through tubing 24. As is typical, screen 20 comprises common sand exclusion media, mesh, or other sand filtering agent sized as necessary to exclude sand or solids from the production stream. The filtering agent of the screen 20 could be affixed to an expandable base pipe (also part of the screen 20) for the purposes of supporting or pressing the agent against the casing 26, or could be run alone without support depending upon the application. The screen may also have, as shown in FIG. 16 and depending on the application, seals 90 on top and/or bottom of the screen 20 to enhance sand exclusion capabilities. Seals 90 can comprise elastomeric seals.

Figure 14:
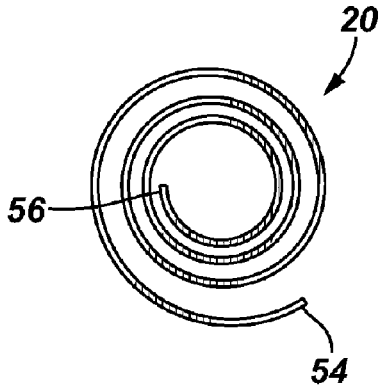
FIGS. 14-15 illustrate the expansion of the screen that comprises the relevant tool.
Figure 15:
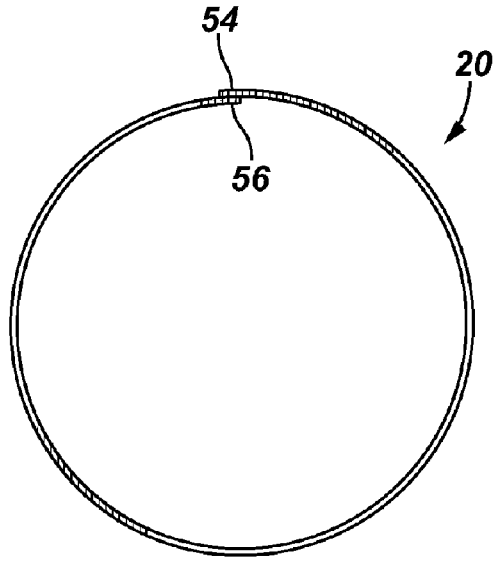

In its unexpanded state and as shown in FIG. 14, sand screen 20 has a scrolled configuration with a first edge 54 of the sand screen overlapping a second edge 56 of the sand screen. The expansion of sand screen 20 occurs by the sand screen 20 unscrolling or being caused to unscroll from the unexpanded state of FIG. 14 to the expanded state of FIG. 15. In the expanded state of FIG. 15, the first edge 54 and the second edge 56 abut or are closer to each other than in the unexpanded state. In one embodiment, sand screen 20 is constructed so that it is biased to unscroll wherein the spring force of the screen 20 helps or causes the expansion of the screen 20. In another embodiment (see FIG. 8), at least one fastener 78 secures the screen 20 in the unexpanded position.

Figure 2:
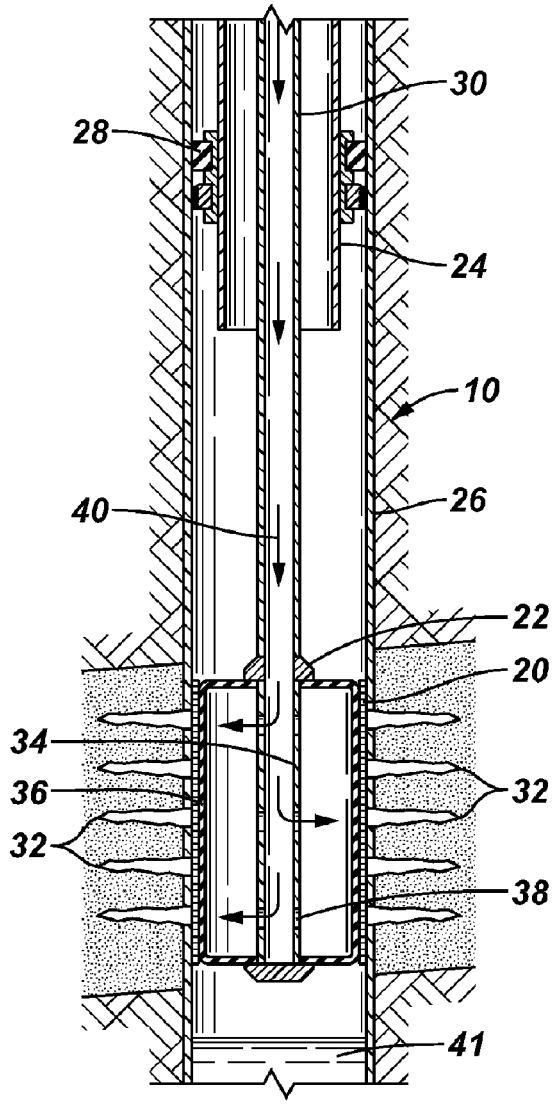

FIG. 1 shows deployment tool 22 adjacent perforations 32. In one embodiment as shown in FIG. 2, sand screen 20 is expanded so that it covers the perforations 32. In that way, sand screen 20 allows hydrocarbon fluid to flow through the perforations 32 and into the wellbore 10, but prevents sand particles from doing so. In order to expand sand screen 20 against casing 26 and perforations 32, the deployment tool 22 is activated to expand the sand screen 20 from its interior diameter until the sand screen 20 abuts the casing 26 and perforations 32.

In one embodiment as shown in FIG. 2, the deployment tool 22 comprises a base pipe 34 and an inflatable membrane 36. The base pipe 34 includes openings 38 therethrough. In an unexpanded state (as shown in FIG. 1), the inflatable membrane 36 is disposed between the unexpanded screen 20 and the base pipe 34, keeping in mind that the overall circumference of the unit as a whole is small enough to be passed through the tubing 24. To expand the membrane 36, a fluid (as shown by arrows 40 in FIG. 2) is transmitted through the interior of the conveyance device 30 (such as in the embodiments wherein the conveyance device 30 comprises a hollow metal tubing or coiled tubing or in the embodiments wherein the conveyance device 30 comprises a wireline or a slickline with a hydraulic conduit included therein or attached thereto). The transmitted fluid 40 then passes through the openings 38 of the base pipe 34 and acts to hydraulically expand the membrane 36 thereby also expanding the sand screen 20. The expansion of the membrane 36 and sand screen 20 is complete once sand screen 20 is securely placed against the interior of the casing 26 and perforations 32.

Appropriate fluids 40 may include drilling fluid, completion fluid, stimulation fluids including gravel slurry, sand consolidation fluids, or any commercial gas.

In the embodiments in which conveyance device 30 is a wireline (without a hydraulic conduit included therein or attached thereto), an electrical signal can be sent to a control device located downhole (not shown), which control device can enable the passage of wellbore fluids into the base pipe 34 to expand the membrane 36 and sand screen 20. The control device can comprise a motor or a valve. Likewise, in the embodiments in which conveyance device 30 is a slickline (without a hydraulic conduit included therein or attached thereto), a force pulse through the slickline (caused such as by quickly lifting the slickline) can be sent to the control device to cause the relevant expansion by use of the wellbore fluids.

Figure 3:
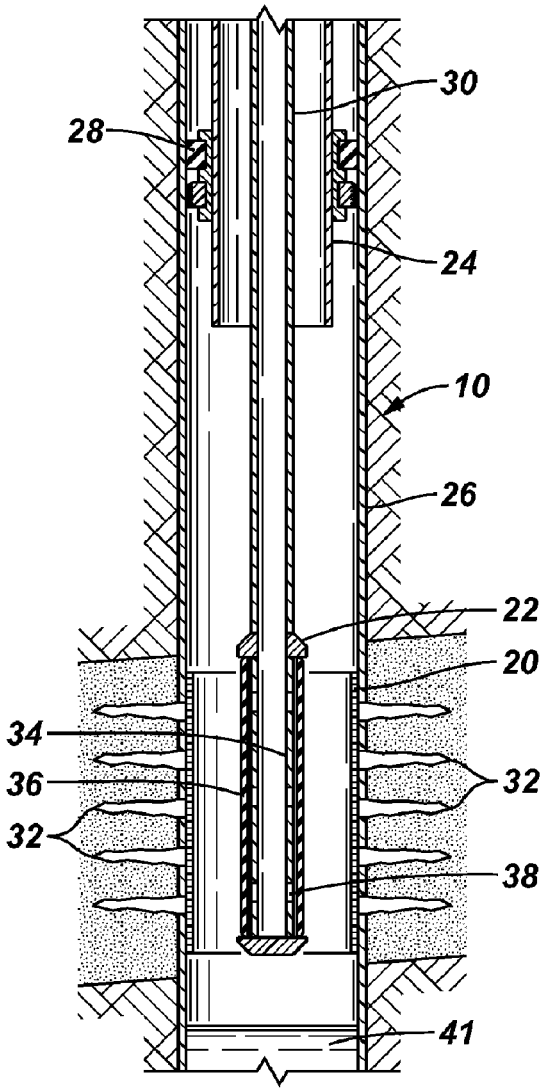

FIG. 3 shows the downhole tool 22 back in its contracted position, leaving sand screen 20 in its expanded state abutting casing 26 and perforations 32. In this position, deployment tool 22 can be pulled out of the wellbore 10 through tubing 24. In the embodiment including a conveyance device 30 that has hydraulic communication with the surface, the fluid 40 is suctioned back from the membrane 36, base pipe 34, and conveyance device 30 thereby also collapsing the membrane 36 to its original, or substantially close to its original, unexpanded state. In this way, the deployment tool 22 (along with the collapsed membrane 36) can be pulled out through the tubing 24. In the embodiment including a conveyance device 30 that does not have hydraulic communication with the surface, a wireline or slickline signal is sent to the relevant control device (as previously described) releasing the wellbore fluids from the interior of membrane 36.

Figure 4:
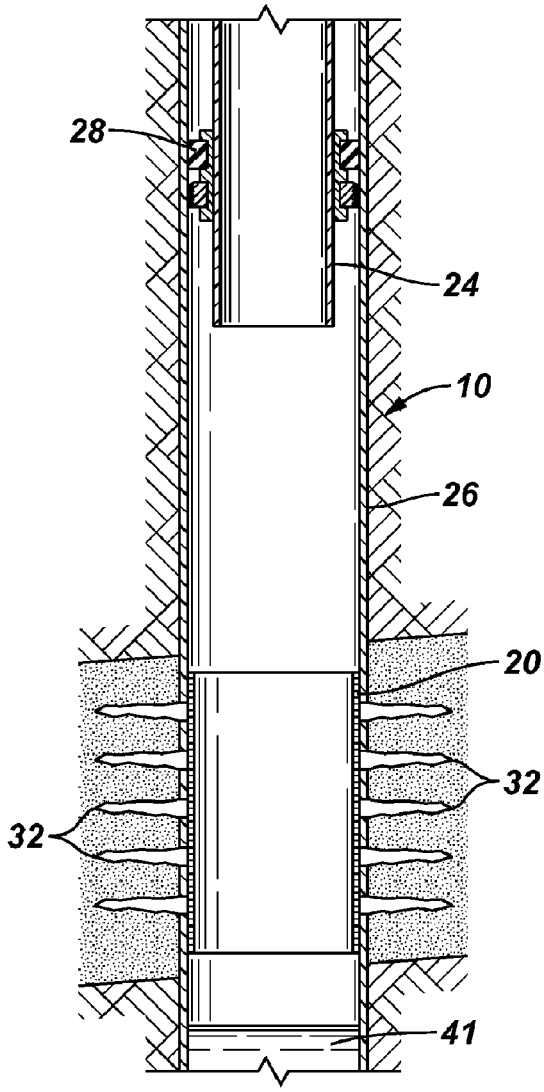

FIG. 4 shows the wellbore 10 with the deployment tool 22 removed. Sand screen 20 is expanded against the casing 26 and perforations 32. As previously disclosed, sand screen 20 allows hydrocarbon fluid to flow through the perforations 32 and into the wellbore 10, but prevents sand particles from doing so. The seals 90, if used, aid in ensuring that all fluid passing into wellbore 10 passes and is thus filtered by screen 20.

As also shown in the Figures, a plug (which may comprise a cement plug) 41 may be in place below tubing 24 and perforations 32. In the embodiment shown in the Figures, the sand screen 20, in its expanded state, is suspended above the plug 41 by the force it keeps against the casing 26 and perforations 32 after expansion. In another embodiment (not shown) the lower end of the screen 20 rests on the plug 41.

In yet another embodiment (not shown), screen 20 comprises an anchor, such as packer slips, that when activated secure screen 20 in its expanded state to the casing 26.

Figure 5:
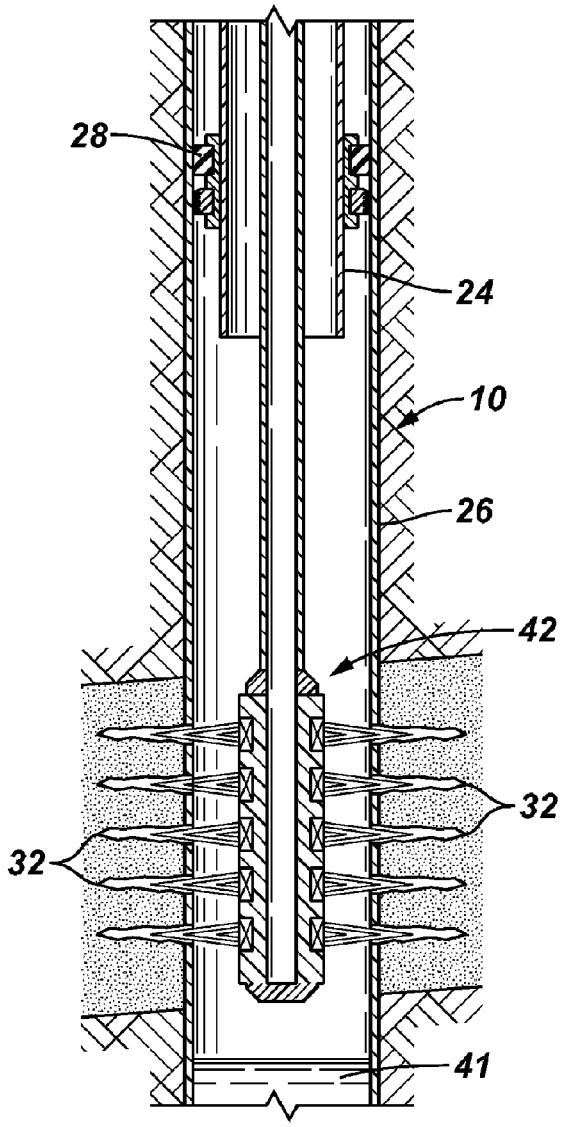
FIGS. 5-7 illustrate steps that may conducted prior to deploying the tool of FIGS. 1-4.
Figure 6:
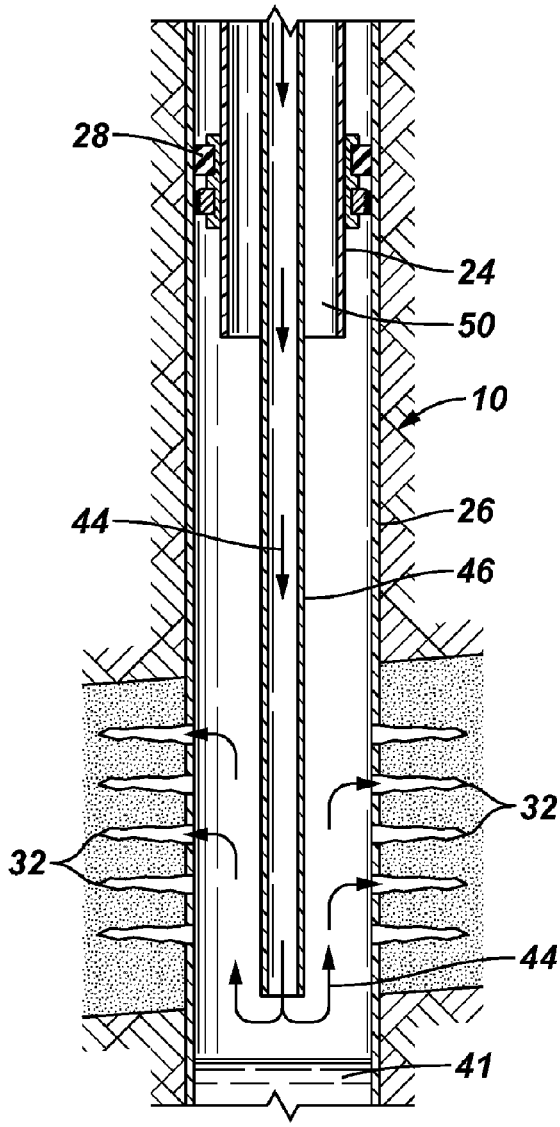
Figure 7:
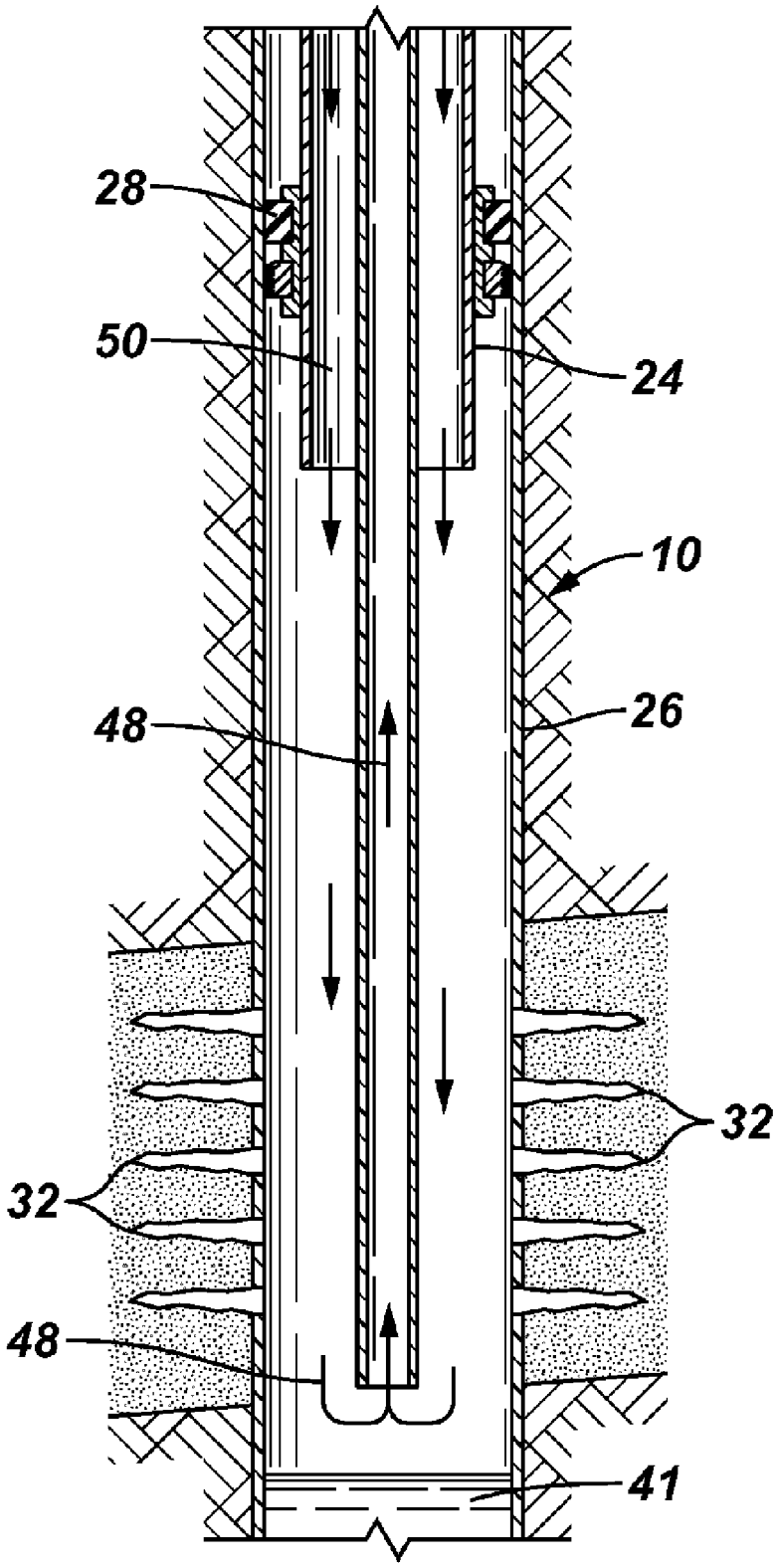

In one embodiment, one or more of the steps illustrated in FIGS. 5-7 are also carried out prior to the steps illustrated in FIGS. 1-4. In FIG. 5, a perforating gun 42 is run through the tubing 24 and is used to perforate the casing 26 (as is known in the art) to create the perforations 32. In FIG. 6, a treatment fluid 44 (which can comprise any packing or fracking fluid) is pumped through a treatment conduit 46 and into the perforations 32. In FIG. 7, a wash out fluid 48 is pumped through the annulus 50 between the tubing 24 and the treatment tubing 46 and is circulated back to the surface through the interior of treatment tubing 46 leaving the wellbore 10 section below packer 28 ready for the steps illustrated in FIGS. 1-4.

Figure 8:
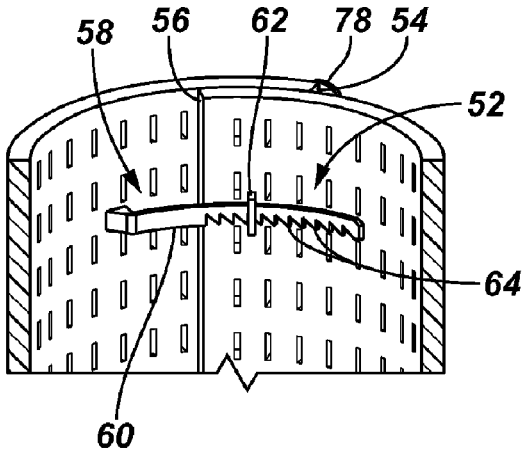
FIGS. 8-9 illustrate a mechanism that locks the relevant tool in place.
Figure 9:
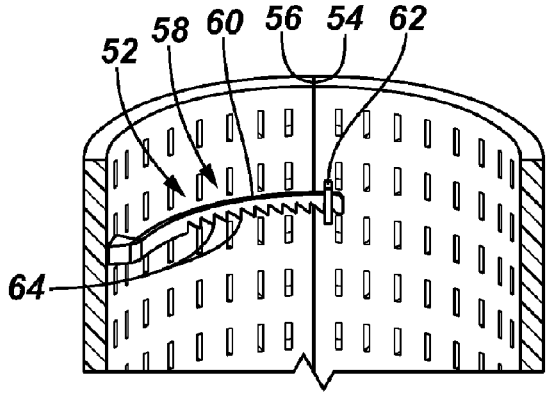

In one embodiment, the spring force of the sand screen 20 is sufficient to maintain the sand screen 20 in its expanded state against the casing 26 and perforations 32. In another embodiment as shown in FIGS. 8-9, at least one lock 52 is used to lock sand screen 20 in the expanded state. FIG. 8 shows sand screen 20 in its unexpanded state with a first edge 54 of the sand screen 20 overlapping the second edge 56 of the sand screen 20. FIG. 9 shows sand screen 20 in its expanded state with the first edge 54 abutting (or being closer to) the second edge 56.

Lock 52 may comprise any mechanism that enables the expansion of but prevents the contraction or collapse of screen 20. In one embodiment, lock 52 comprises a ratchet mechanism 58 that includes a ratchet finger 60 and a ratchet receiver 62. The finger 60 is attached to the sand screen 20 adjacent the first edge 54, and the receiver 62 is attached to the screen 20 adjacent the second edge 56. As the screen 20 is expanded, the first edge 54 and the second edge 56 move closer to each other from their relative positions shown in FIG. 8 to their relative positions shown in FIG. 9 (wherein the edges 54, 56 abut or are relatively closer together). The finger 60 includes ratcheted edges 64 that are configured so as to enable the relative movement of the first and second edges 54, 56 to allow the expansion of screen 20. However, the ratcheted edges 64 are also configured to lock the movement of the first and second edges 54, 56 to prevent the contraction of the screen 20 as the expansion is advanced from edge 64 to edge 64. Once in the final expanded state as shown in FIG. 9, the ratchet mechanism 58 maintains the screen 20 in the expanded state against casing 26 and perforations 32 and prevents the screen 20 from collapsing or compressing despite any change in the environment (including differential pressure across the screen 20) through time.

In one embodiment, a plurality of locks 52 or ratchet mechanisms 58 are used on screen 20. In one embodiment, at least one lock 52 or mechanism 58 is located near each longitudinal end of the screen 20. Although the Figures show lock 52 located in the interior surface of the screen 20, in another embodiment lock 52 may be located in the exterior surface of the screen 20.

Figure 17:
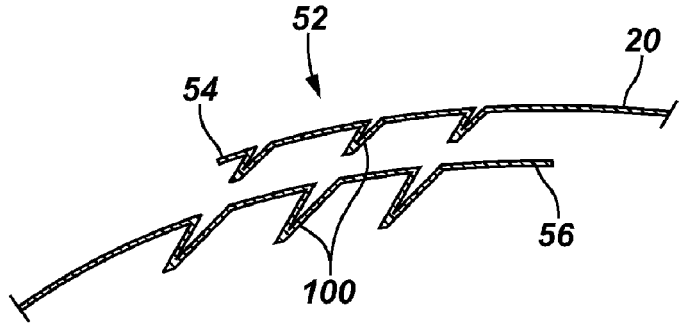
FIG. 17 illustrates another mechanism that locks the relevant tool in place

In another embodiment as shown in FIG. 17, the lock 52 is integral with the screen 20. In this embodiment, each edge 54, 56 of the screen 20 has ratchet teeth or interlocking profiles 100 machined or attached thereon so that the teeth or profiles 100 interlock and thereby secure the screen 20 in the expanded state upon expansion.

Figure 10:
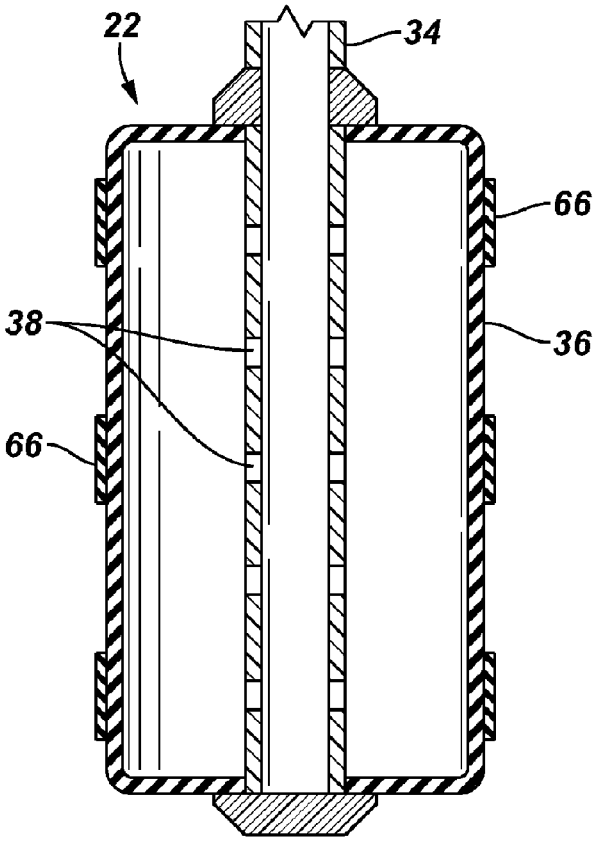
FIGS. 10-11 illustrate a guard that protects a portion of one embodiment of the deployment tool used with the present invention.
Figure 11:
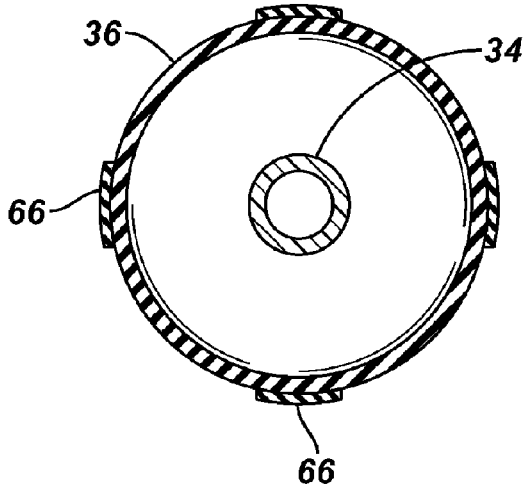

FIG. 10 shows a close up view of the expanded deployment tool 22 also illustrated in FIGS. 1-3. FIG. 11 shows a top view of the same expanded deployment tool 22. As previously disclosed, deployment tool 22 includes a base pipe 34 with openings 38 and a membrane 36. However, the deployment tool 22 of FIGS. 10 and 11 also includes at least one guard 66 attached to the exterior of the membrane 36. Guard 66 protects the membrane 36 as it acts against the screen 20 to expand the screen 20 from the unexpanded to the expanded state. The use of at least one guard 66 is beneficial since the screen 20 tends to be made of a metallic or relatively hard material and includes holes to enable the flow of hydrocarbon fluids therethrough. On the other hand, the membrane 36 is made of a relatively softer elastomer material that may be pierced by the screen 20 during the expansion process. In one embodiment, a plurality of guards 66 are placed along the longitude of membrane 36. Also in one embodiment, each guard 66 is segment-shaped as best shown in FIG. 11. In addition, the guards 66 are sized and constructed so as to fit together in the unexpanded state of deployment tool 22 and also to allow the passage of the deployment tool 22 through the tubing 24 both at the time of deployment (see FIG. 1) and at the time of retrieval (see FIGS. 3 and 4). Each guard 66 may be made from rubber or elastomer.

Although not shown in the Figures, in one embodiment, one screen 20 is constructed to be long enough to cover the casing 20 over a region of more than one set of perforations. Also, in another embodiment, multiple deployment tools, each with a screen, may be run on the same conveyance device 30. In this embodiment, the multiple deployment tools and screens are set apart from each other so as to mirror the distance between sets of perforations on the casing. Thus, multiple screen expansions may be performed in one trip.

Figure 12:
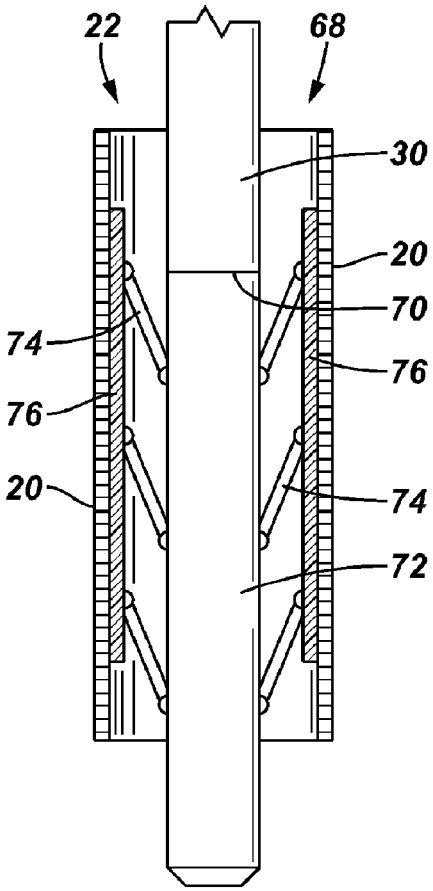
FIGS. 12-13 illustrate another embodiment of the present invention.
Figure 13:
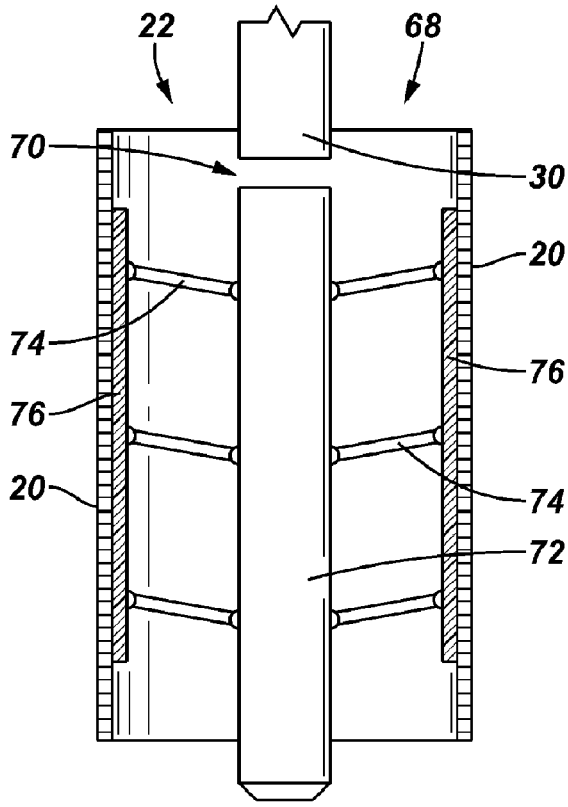

FIGS. 1-3 and 8-11 illustrate one embodiment of the deployment tool 22. Other possible embodiments also exist. For instance, as shown in FIGS. 12 and 13, a deployment tool 22 with a mechanical actuating mechanism 68 is illustrated. In this embodiment, the deployment tool 22 is deployed on a conveyance device 30 that is removably attached to the deployment tool 22 at release mechanism 70. The deployment tool 22 comprises a base pipe 72, a plurality of arms 74, and supports 76. The base pipe 72 and one end of each arm 74 are pivotally attached to each other. The opposite end of each arm 74 is pivotally attached to a support 76 that is then fixedly attached to the screen 20.

FIG. 12 shows the unexpanded state of deployment tool 22 and screen 20. In this unexpanded state, the deployment tool 22 (with screen 20 thereon) is configured so that the unit can be deployed through tubing 24, as previously disclosed. For the embodiment of FIG. 12, each of the arms 74 is pivoted in relation to the base pipe 72 and the screen 20 to enable such deployment through tubing 24.

FIG. 13 shows the expanded state of deployment tool 22 and screen 20. In this expanded state, the deployment tool 22 (with screen 20 thereon) is configured so that the screen abuts against the casing 26 and perforations 32. For the embodiment of FIG. 13, each of the arms 74 is pivoted in relation to the base pipe 72 and the screen 20 to enable the outward expansion of the screen 20 as previously disclosed. In comparison, the arms 74 in the expanded state are in a position closer to perpendicular than in the unexpanded state. In order to lock the screen 20 in the expanded state, each arm 74 may be provided with a ratchet mechanism or mechanical stop that is sized to lock upon expansion of the screen inside the casing ID.

The operation of the embodiment of FIGS. 12-13 is as follows. Once the deployment tool 22 is in the proper position, a mechanical movement of the conveyance device 30 (such as a quick movement up or sideways or an impact against plug 41 releases the deployment tool 22 from its unexpanded position) enables the screen 20 to expand by its spring force against the casing 26. Continued expansion and locking against the casing 26 occurs by lifting the conveyance device 30 upwards thereby causing continued outward movement of the screen 20. Once the screen 02 is secure against the casing 20, continued upward movement acts against the release mechanism 70 which is preset to release at a certain force. Once this force is reached, the release mechanism releases the deployment tool 22 from the conveyance device 30 thereby enabling the conveyance device 30 to be retrieved with the deployment tool 22 remaining downhole locking screen 20 in place against the casing 26 and perforations 32. Release mechanism 70 may comprise a shear pin or collet arrangement.

In one embodiment, the surface at which the screen 20 is to be deployed has an inside diameter equal to the diameter of the screen in the unexpanded state. It is understood that in this embodiment the screen is released from the deployment tool and not necessarily "expanded". Nevertheless, the term "expanded" as used herein incorporates this embodiment as well.

Figure 18:
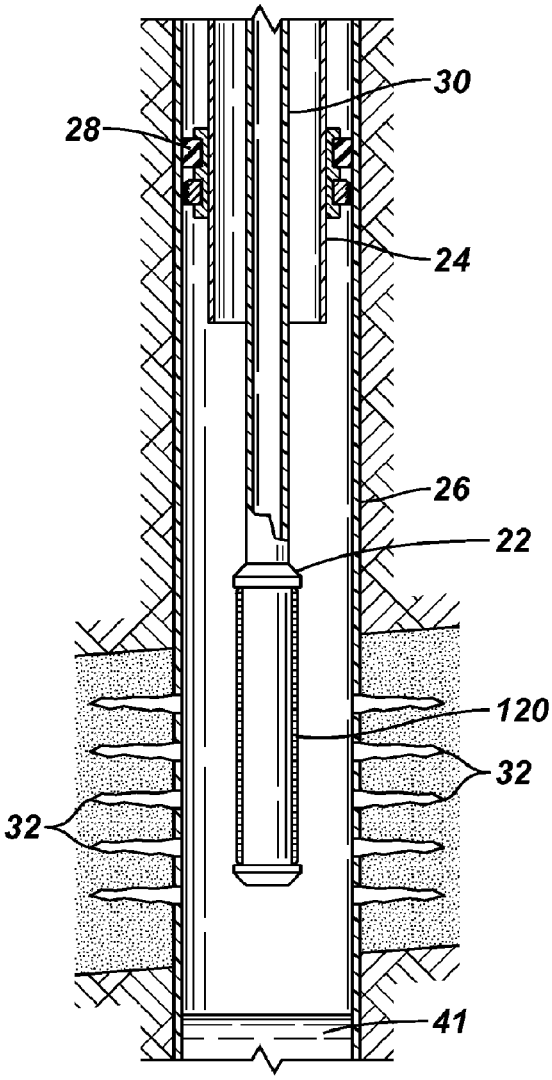
FIGS. 18-21 illustrate another embodiment of the present invention including two trips.
Figure 19:
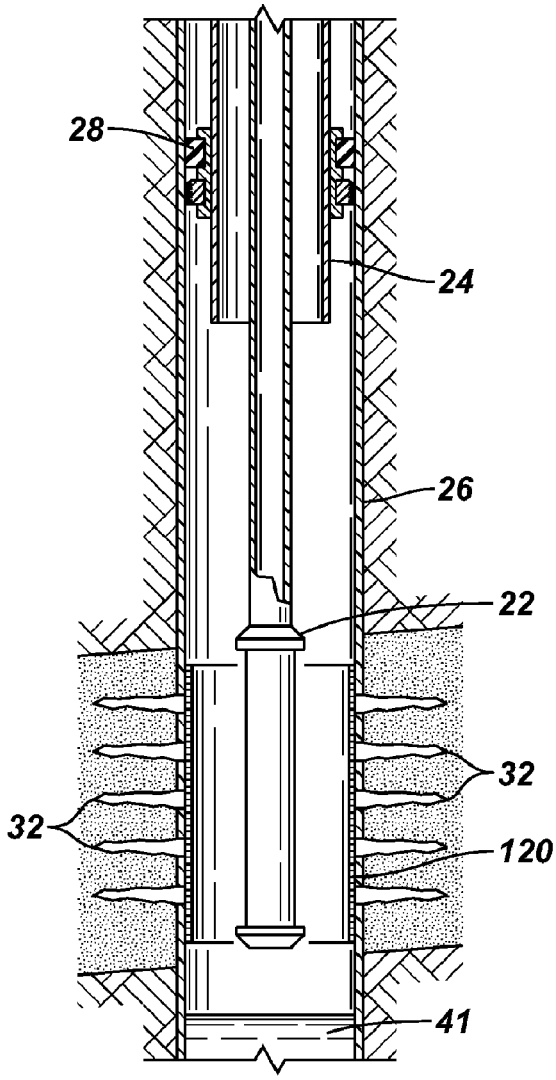
Figure 20:
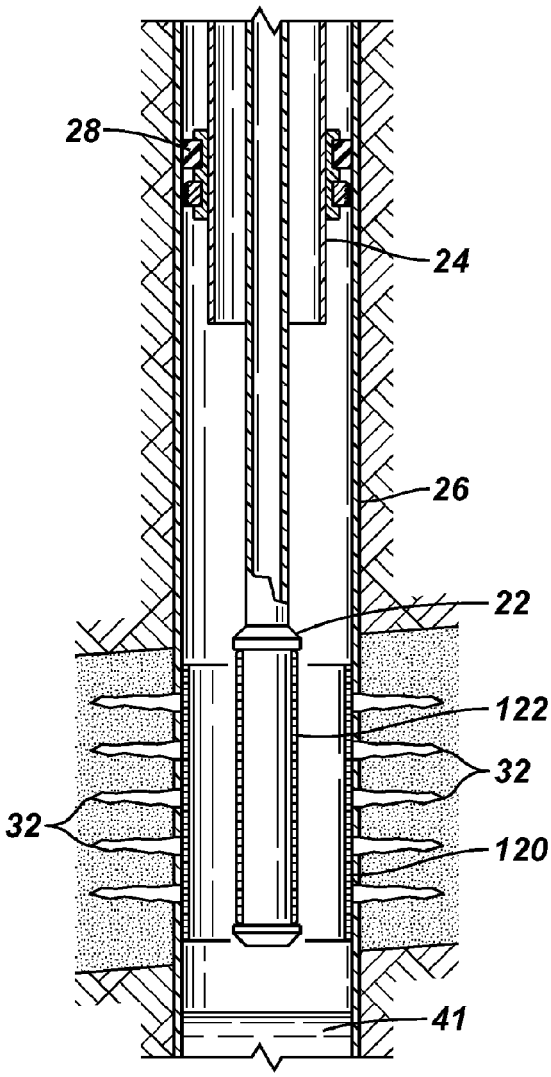
Figure 21:
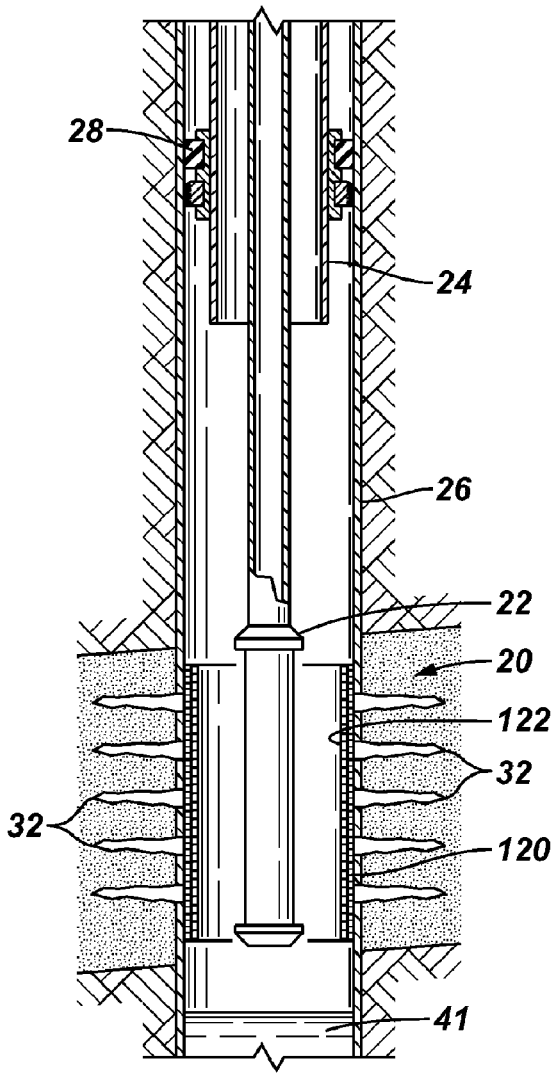

FIGS. 18-21 are similar to FIGS. 1-4, except that in the embodiment shown in FIGS. 18-21 the screen 20 is deployed in two trips. A screen 20 is typically constructed from a filter media 120 and a support structure 122, with the filter media 120 surrounding and being supported by the support structure 122. In the first trip as shown in FIGS. 18 and 19, the filter media 120 is deployed on the deployment tool 22 and is then unscrolled against the casing 26 as disclosed herein to the expanded state. In the second trip as shown in FIGS. 20 and 21, the support structure 122 is deployed on the deployment tool 22 and is then unscrolled against the interior of the already expanded filter media 120 as disclosed herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system comprising:

a sand screen adapted to be scrolled in an unexpanded state and unscrolled into an expanded state;

a deployment tool affached to a conveyance device and to the sand screen, the deployment tool comprising an inflatable membrane to expand the sand screen from the unexpanded state to the expanded state; and at least one guard disposed between the membrane and the sand screen to prevent the sand screen from piercing the membrane during the expansion of the sand screen.

2. The system of claim 1, wherein the sand screen is adapted to expand against an inner casing surface in the expanded state.

3. The system of claim 1, wherein the deployment tool comprises a basepipe with means to communicate fluid pumped though the conveyance device to inflate the membrane.

4. The system of claim 1, wherein the sand screen comprises at least one lock to secure the sand screen in the expanded position.

5. The system of claim 4, wherein the lock comprises teeth.

6. The system of claim 1, wherein the deployment tool is retrieved from the well after the expansion of the sand screen.

7. A method usuable with a well, comprising:

deploying a scrolled sand screen on a deployment tool though a tubing in a wellbore;

inflating an inflatable membrane to unscroll the sand screen to cause the sand screen to expand against a surface in the well; and protecting the membrane from being pierced by the sand screen during the expansion of the sand screen, comprising radially disposing at least one guard between the membrane and the sand screen.

8. The method of claim 7, wherein the act of expanding comprises expanding the sand screen against a casing that surrounds the tubing.

9. The method of claim 7, wherein the act of expanding comprises expanding the sand screen against perforations formed on a casing.

10. The method of claim 7, wherein the act of inflating comprises pumping fluid through a conveyance device and the deployment tool to inflate the membrane.

11. The method of claim 7, further comprising:

locking the sand screen in the expanded position.

12. The method of claim 7, further comprising:

retrieving the deployment tool from the well after expanding the sand screen.

13. A system usable with a well, comprising:

a sand screen having a first scrolled unexpanded state and a second unscrolled expanded state, the sand screen comprising seals located at ends of the sand screen;

a deployment toot attached to the sand screen to, downhole in the well, expand the sand screen from the unexpanded state into the expanded state against an inner casting surface such as that when the sand screen is expanded against the surface, the seals form an isolated annular region between the sand screen and the surface;

wherein the deployment tool comprises an inflatable membrane to expand the sand screen; and wherein at least one guard is disposed between the membrane and the sand screen to protect the membrane during expansion of the sand screen.

14. The system of claim 13, further comprising:

a lock to secure the sand screen in the expanded position.

15. A method usable with a well, comprising:

running a scrolled sand screen in an expanded state downhole in the well;

after the running, expanding the sand screen against a casing surface by unscrolling the sand screen into an expanded state, wherein the act of expanding comprises inflating an inflatable bladder;

protecting the bladder from being pierced during the expansion of the sand screen, comprising radially disposing at least one guard between the bladder and the sand screen; and using seals at either end of the sand screen device in the expanded state of the sand screen to form an isolated annular region between the surface of the casing and the sand screen.

* * * * *